US007426157B2

(12) United States Patent
Arnold et al.

(10) Patent No.: US 7,426,157 B2
(45) Date of Patent: Sep. 16, 2008

(54) ELECTRONIC PRACTICE DEVICE

(76) Inventors: Nathan James Arnold, 2435 E. North St. #156, Greenville, SC (US) 29615; Greg J. Owoc, 2435 E. North St. #130, Greenville, SC (US) 29615; William Palmer Lovegrove, 201 Griffin Dr., Greenville, SC (US) 29607

( * ) Notice: Subject to any disclaimer, the term of this patent is extended or adjusted under 35 U.S.C. 154(b) by 373 days.

(21) Appl. No.: 10/793,203

(22) Filed: Mar. 4, 2004

(65) Prior Publication Data

US 2005/0195691 A1 Sep. 8, 2005

(51) Int. Cl.
*G04C 19/00* (2006.01)
*G04F 10/00* (2006.01)

(52) U.S. Cl. ..... 368/82; 368/108; 368/111

(58) Field of Classification Search ..... 368/9–11, 368/71, 76, 82, 107, 108
See application file for complete search history.

(56) References Cited

U.S. PATENT DOCUMENTS 3,880,147 A * 4/1975 Gruenke et al. ..... 600/515
D243,748 S 3/1977 Krause
4,090,355 A 5/1978 Morohoshi
4,726,687 A * 2/1988 Gander ..... 368/10
4,995,018 A 2/1991 Edwards
5,027,686 A 7/1991 Ishikawa
D323,469 S 1/1992 Saito
D331,018 S 11/1992 Watonabt
5,195,061 A * 3/1993 Curtis et al. ..... 368/9
5,253,228 A 10/1993 Truett
5,327,403 A 7/1994 Bond
D360,144 S 7/1995 Omuro
5,796,681 A * 8/1998 Aronzo ..... 368/10
5,877,953 A 3/1999 Clemenden
6,069,848 A * 5/2000 McDonald et al. ..... 368/107
D430,045 S 8/2000 Omuro
6,323,783 B1 * 11/2001 Lizzi et al. ..... 340/5.1
6,577,877 B1 * 6/2003 Charlier et al. ..... 455/557

* cited by examiner

*Primary Examiner*—P. Austin Bradley
*Assistant Examiner*—Thanh S. Phan

(57) ABSTRACT

An interval timer combining the features of a practice timer, means of measuring date and metronome into a single device for the purpose of measuring, recording, and displaying practice records over a period of weeks or months. During the measuring of practice time, the device may complement the passage of time by the use of lights, sounds, or vibrations. It features a display screen that can indicate total time practiced, current chronological time and date, and a record of practice accomplished over a period of chronological time. The device may also accommodate interchangeable face plates of electronic icons for user personalization of the device. An enhanced version may include means for displaying assignment and practice information.

23 Claims, 9 Drawing Sheets

Fig. 2a
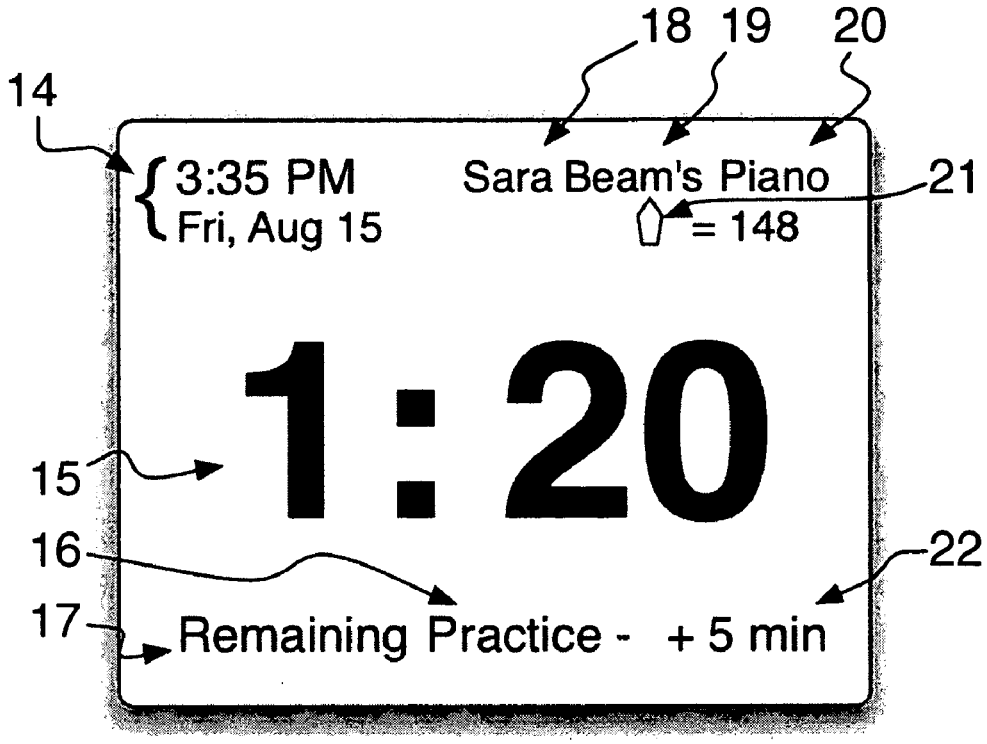
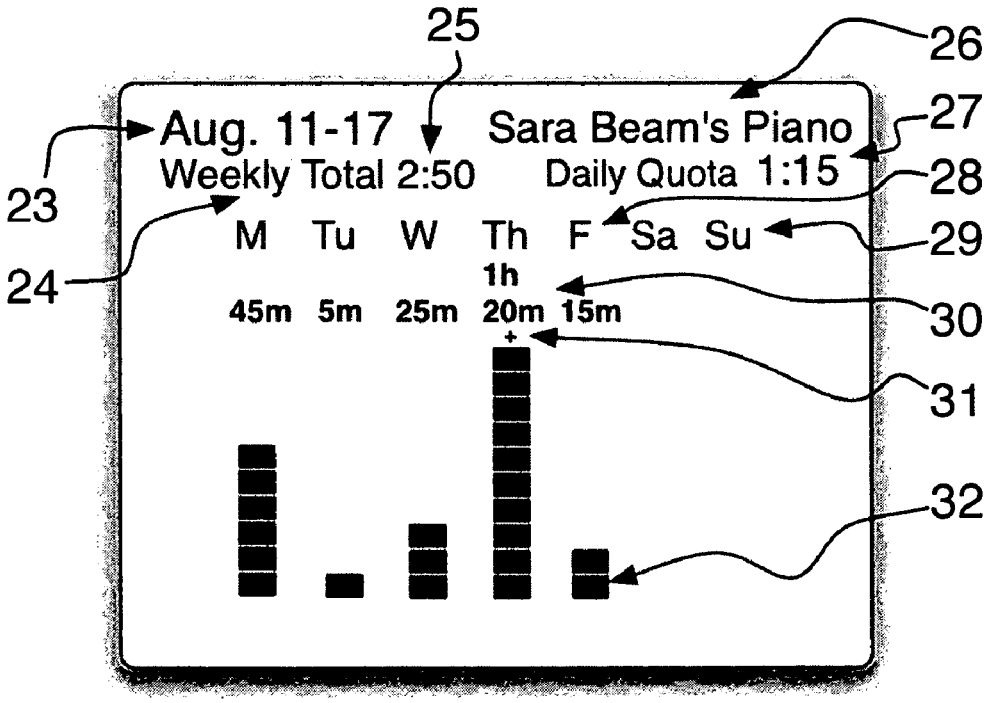
Fig. 2b

Fig. 2c
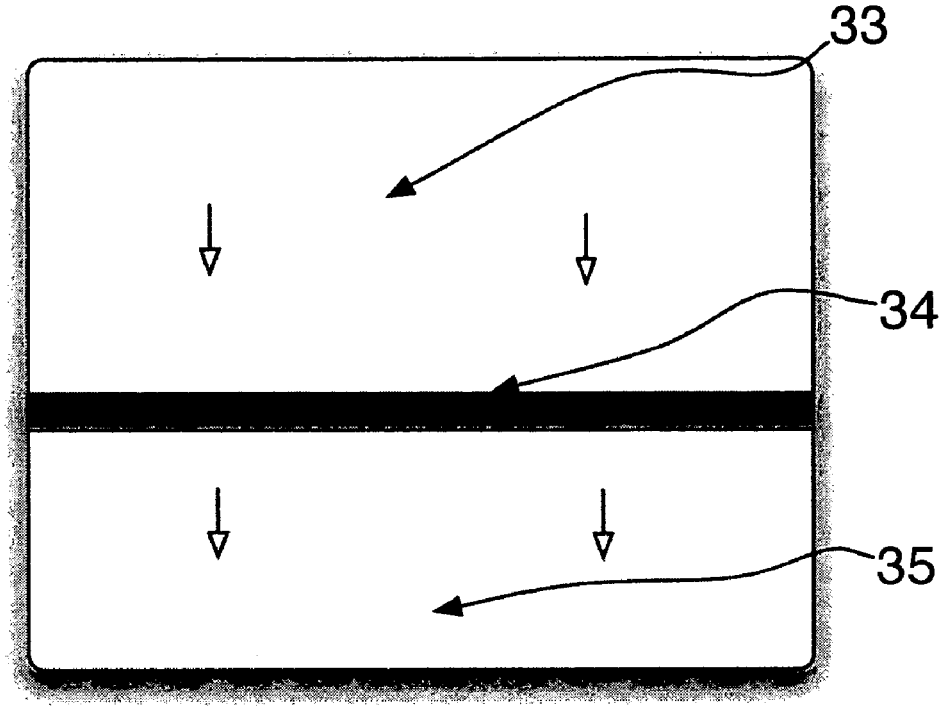
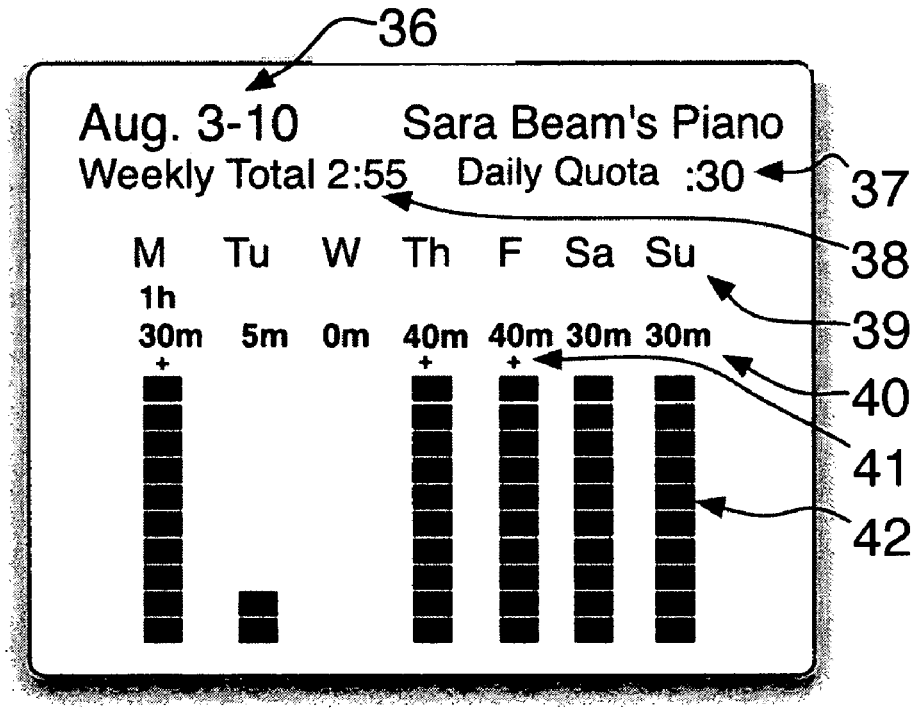
Fig. 2d

Fig. 2e
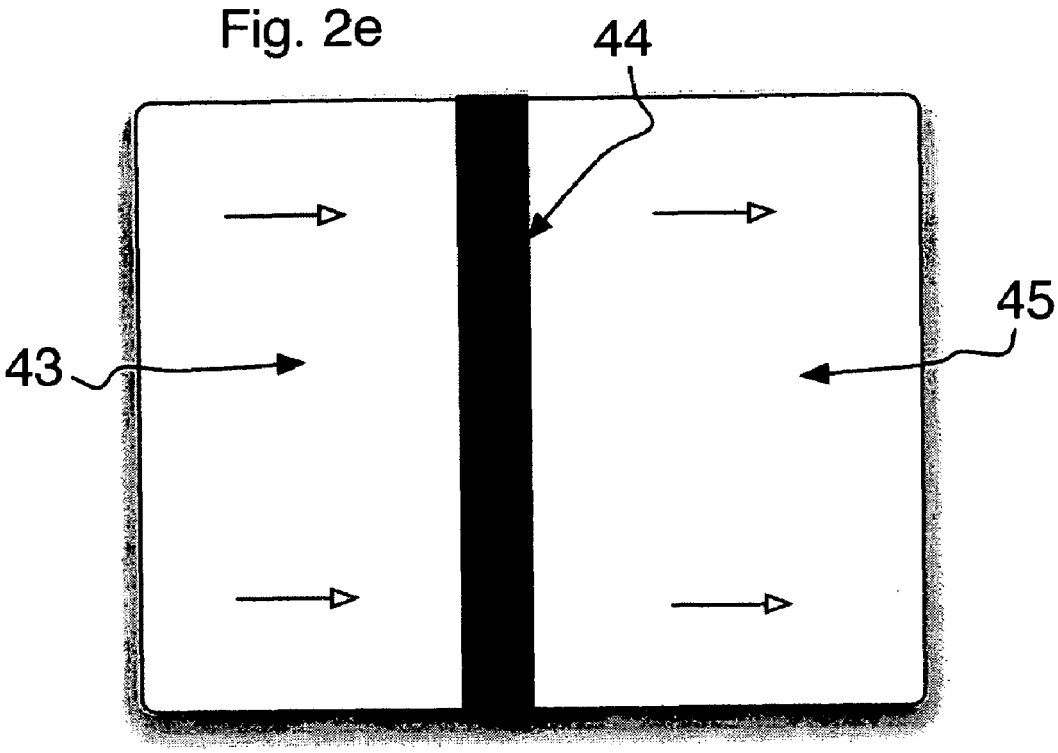
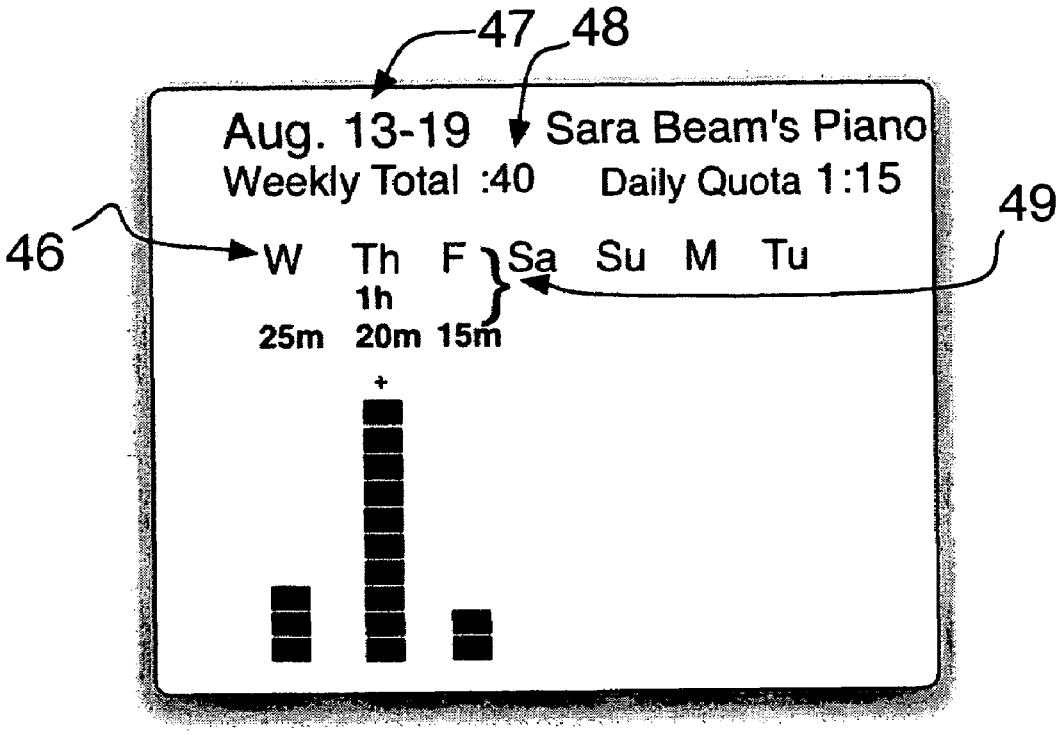
Fig. 2f

ELECTRONIC PRACTICE DEVICE

BACKGROUND OF THE INVENTION

1. Field of the Invention

The present invention relates to interval timers, more particularly, to a timer that measures a user-defined duration of time and records the measurement of that time over a period of weeks or months.

2. Description of the Prior Art

The Curtis patent U.S. Pat. No. 5,195,061 refers to a practice timer for measuring time spent productively in an activity with a minimum of interference with the activity. The described device includes a sound-sensing device which records the actual amount of time an instrument is being played. As described in the patent, the musician may then compare the productive time with the elapsed chronological time to determine profitable practice time. The device describes possible integration with a metronome incorporating special circuits to prevent metronome sound from interfering with the sound-sensing circuitry.

The present invention, which may herein also be referred to as the PractizPal, differs greatly from the Curtis patent in both purpose and function. First of all the PractizPal is highly integrated with a built in means of measuring date. This feature which is not included in the Curtis patent allows the PractizPal to not only measure the length of a practice session, but also to record and tabulate practice times over a period of weeks or months. This feature allows teachers and students to review the accumulated amount of practice time over an extended period of time providing for more efficient record-keeping and greater accountability. This function is not possible without the integration of a means of measuring date.

The primary difference in the PractizPal and the Curtis patent is that the amount of time practiced recorded by the PractizPal is entirely user defined. The measurement of practice time as described in the Curtis patent is the result of the device's measurement of productive practice, the comparison of this productive time with actual elapsed time being in fact the primary function of the device. The function of the PractizPal relies entirely on user input to define practice time, the user pressing a button to indicate the beginning and end of practice time. The purpose of the PractizPal is not to distinguish profitable practice time from unprofitable practice time, nor is it capable of doing so. A sound-sensor built into the PractizPal simply acts as an auto-shutoff feature that prevents the user from unintentionally recording extended amounts of practice time. The auto-shutoff feature can be easily overridden or turned off by the user.

Patents such as the Clemenden patent U.S. Pat. No. 5,877,953 deal with elapsed time recording allowing a user to track, record and retrieve time information for billing purposes, allowing the user to start a "timer" to track an account's activity, the device keeping track of total accumulated time. It also allows the user to review a record of date and time for the beginning and end of each time segment as well as a the total elapsed time for billing purposes.

The function of the PractizPal timer differs in several aspects. First of all, as it is intended for the specific purpose of recording time elapsed in music practice rather than tabulated time for billing purposes, it features an entirely different system of recording time. The Clemenden patent records the total elapsed time on a specific project which could cover various amounts of time. For example, a total accumulated time of 15 hours on a given project could have elapsed over the course of several months, or within a 24 hour period.

Such information is not relevant in regards to time elapsed in music practice since practice time is evaluated in segments of a week or the time elapsed between music lessons. More specifically, a time record of music practice requires tabulation of the total amount of accumulated practice time in individual 24 hour periods in order to evaluate practice patterns.

The importance of this specific organization in regards to music practice is evidenced by the example of paper practice records which consistently organize practice times by week, and more specifically by the day of each week. Although this organization is necessary to meet the specific requirements of a music practice record, it is irrelevant to the function of the Clemenden patent which due to its intended use for billing purposes, requires only the indication of the total elapsed time regardless of when it took place.

As the metronome is a device used specifically for the purpose of music practice, the addition of this function to the device further specifies it for use in relation to music practice.

The Ishikawa patent, U.S. Pat. No. 5,027,686 refers to the combination of a metronome that is related to a subtraction timer, causing the metronome to shut off after a user defined period of time, and delivering a time-up sound. As in the case of the Curtis patent, the PractizPal differs from the Ishikawa patent in that the PractizPal is highly integrated with a built in means of measuring time and date which is necessary for the described function of the device. One of the primary purposes of the PractizPal is to make students more accountable to their teachers who by observing a students practice record, can point out the relationship between lack of practice and lack of musical progress. As students are often themselves unaware of their own consistent failure to practice, the PractizPal also allows them to see the regularity of their practice patterns. A high level of integration with a means of measuring time and date is necessary for this purpose.

Because the Ishikawa patent lacks any means of measuring date, or memory regarding the time of day or date upon which a practice session began or ended, the device it describes is not able to retain any past record of time practiced or accumulated practice time over the course of a day or a week, and is therefore unable to accomplish this function.

Not only is the integration of a means of measuring date and time of day necessary for the maintaining of a practice record that can be viewed by a student or teacher, it is also necessary for the tabulation of segmented practice time that takes place over the course of a 24 hour period. One of the primary functions of the PractizPal is its ability to accumulate practice time over a 24 hour period regardless of the number of practice segments, thereby allowing a musician to start or stop their practice time as necessary while still tabulating the total elapsed time in a day's practice. For example, the integration of a built in means of measuring date would allow the PractizPal to record 5 (or more) distinct periods of music practice within a 36 hour period, then selectively tabulate those practice segments according to the time of day and date on which they took place. The means of measuring date is also necessary for features that allow a teacher to set a practice quota such as 30 minutes for a sequence of 24 hour periods, and the ability to relate an accumulation of practice segments to that quota. The PractizPal also allows the user to continue practice beyond their assigned quota of practice time, indicating to the user the amount of extra time they have practiced within a certain 24 hour period of time, once again a function that is not possible without integration with a means of measuring time and date.

Patents such as the Edwards patent, U.S. Pat. No. 4,995,018, the Truett patent, U.S. Pat. No. 5,253,228 and the Bond patent, U.S. Pat. No. 5,327,403 refer to the use of LED lights for time measuring purposes. LED lights used in the PractizPal are an aesthetic enhancement and not in any way integral to the function of the device. Their purpose is to complement the LCD timer display on the PractizPal screen, their presence indicating that the PractizPal is tabulating practice time. The lights are not actually used to specify the occurrence of certain events or actual time of day.

The Morohoshi patent U.S. Pat. No. 4,090,355 refers to the use of different light color LED chips to distinguish upbeats and downbeats within a metronome. Changes in the color of the LED lights used in the PractizPal are for an aesthetic correlation with the timer and not related to the metronome function of downbeats or upbeats.

Potentially relevant metronome design patents include the Omuro patents Des. No. 430,045, and Des. No. 360,144, and the Saito patent Des. No. 323,469.

Other potentially relevant design patents include the Watanabe patent Des. No. 331,018 for a clock timer and the Krause patent Des. No. 234,748 for an interval signaling timer.

Any aspiring musician who has undertaken the study of a musical instrument has soon discovered its greatest difficulty-practice. Though essential for musical mastery, this hurdle is one that is especially difficult for younger students with other competing interests and short attention spans.

One of the primary ways this problem has been addressed in the past is through printed practice records. Unfortunately these books require a student to time his own practice sessions throughout the course of a day, add up all of his practice time, and record it in his practice book. Many practice books contain around two months of practice records requiring as many as six books per year. Most printed practice books serve no other purpose than record keeping and contribute nothing to actual practice sessions. They represent just one more drudgery in practice's long grueling routine.

SUMMARY OF THE INVENTION

It is therefore an object of the present invention to combine the features of a practice timer, chronometer, and metronome to enable more efficient practice time and more accurate keeping of practice records.

It is also an object of the present invention to maintain a long-term record of practice history that is viewable by teacher and student, while requiring nothing more from the student than daily indication of practice starting and ending times.

It is also an object of the present invention to allow an infinite number of practice segments within a period of time automatically providing the total amount of time elapsed in practice during that same period.

It is also an object of the present invention to eliminate the need for paper practice records that need replacing by substituting them with an electronic calendar that can be, configured to meet each students practice preferences.

It is also an object of the present invention to allow practice to be transmitted via infrared, radio waves, physical contacts or other means from a personal computer, handheld PDA, or specially designed teacher device for entering and recording assignment information for enhanced display, transmission, or record keeping.

It is also an object of the present invention to provide an electronic assignment pad for teachers to record the names of pieces assigned for a student's practice along with info regarding each piece (practice instructions or recommended time of practice).

It is also an object of the present invention to indicate the passing of time during a practice session through the digital display of a countdown timer related to user defined practice quota, as well as through changes in color of LED lights, electronic sounds, or vibrations.

It is also an object of the present invention to provide an electronic practice device that can be upgraded with additional software or hardware in order to meet the various needs of individual students.

To achieve the foregoing and other objects of the invention, there is provided the following embodiments of an activity timer for measuring elapsed time in music practice, recording that time electronically, integrating that record with a means of measuring date and displaying the history of the elapsed practice time over a period of weeks or months.

The preferred embodiment of the PractizPal is as a metronome sized device small enough to clip to the top of a music stand or by extending a built-in balance stand on the back of the device to place on a flat surface such as a table or piano top. The device would feature the ability to measure elapsed time in music practice, record the measurement of that time, relate that measurement to an integrated means of measuring date and time of day, and display the record of that elapsed time over a period of weeks or months. The device could be further combined with a metronome. It could also feature the ability to display a data record of assigned songs and information regarding those assigned songs.

The device would allow the user to utilize various input means to indicate information such as the beginning and ending of a practice session, the first and last names of the user, the required amount of time within a certain period, and other user defined settings. When a user indicated the beginning and ending of a practice session, the device would then retain an electronic record of the time and date of user indicated practice time in a built in memory component over a period of days, weeks, months, or years.

The timer would then be able to integrate that electronic practice record with a built in means of measuring date providing a precise relation of practice time to the date and time at which the practice took place. The device would then be capable of calculating and displaying various user-specified organizations of the practice time such as total practice in a day, total practice in a week, total practice in a month, comparison to a user specified practice quota for a day, week, month, or year, or displaying of a total accumulated amount of user-specified practice time over a period of days, weeks, months, or years.

The device would also be capable of displaying those organizations of daily practice totals in various graphical formats including but not limited to a bar graph or circular pie graph, thereby representing the amount of practice accumulated on each day of a given week. In an organization based on week, the user would be able to configure the device to begin a week on a user specified choice of day. This would allow a student to display an entire week of practice time based on when his or her lesson occurred.

The device would be able to provide feedback to the user regarding device functions including but not limited to the passing of practice time, metronome functions, or other device functions by means of colored LED lights mounted either externally or internally in an illuminating function, designated sounds or musical sequences, physical vibrations created internally by the device, recorded or synthesized voice messages, visual graphic display of images either still or animated, or communication with other external electronic devices. These indicators would enhance the aesthetic appearance of the device while also enhancing the user experience regarding various functions of the device. The enhancement of the user experience could be accomplished in various ways such as providing feedback to indicate when practice was in progress, or providing feedback in a kind of award system to indicate when a practice quota was completed.

The device would also be able to communicate with other external devices using various means of communication including but not limited to radio waves, infrared waves, USB1 or USB2, Firewire connection, docking station, Bluetooth standard, WiFi connection, ethernet connection, TCP/IP, MIDI devices or other means of electronic communication.

It would use these means of communication to relate to other external devices such as those running the Palm, PocketPC or other operating systems, personal computers such as those running Mac OS, Windows, Linux or other operating systems, cell phones, internet servers, SOHO networks, MIDI controllers or other external electronic devices.

The device would be able to send and receive data to and from these external devices including but not limited to practice history or other practice information, assigned practice quotas, information regarding assigned songs, practicing instructions for various songs, recommended amount of time to spend practicing certain songs, music dictionaries or other reference works, updates to the device's internal functions, software or firmware systems, other music related information, signals that allow the apparatus to control another device, signals that allow other devices to control the apparatus, or information that allows the timer to augment the function of other external devices or enhance its communication functionality with other devices.

The ability of the device to communicate with external devices by sending and receiving date through various electronic means, would enable the function of the device to be enhanced by these devices or enhance their own function. An example would be an input device that would allow teachers to assign songs for practice or to give students information regarding those songs. The ability of the device to communicate would also allow it to relate to computer software or transmit practice information for recording, displaying, or printing practice records. The ability of the device to relate to the internet directly or through a secondary external device, would allow it to send practice information to an external device in a remote location and also to receive song assignments and information from an external device in a remote location.

The device could also use a microphone or sound activated sensor for the purpose of triggering a switch to suspend the accumulation of practice time and prevent the user from unintentionally accumulating practice time. The user to would be able to override the auto shutoff switch wherein the timer would continue to accumulate practice time.

The device would also be able to use a built in microphone to receive voice commands that would activate or deactivate various functions in the device, or record music or other types of sound for internal storage and playback. It could also use use other previously mentioned means of communication such a MIDI interface to record MIDI information from an external MIDI controller for storage, editing, viewing, or later playback.

These features could be used for various purposes such as recording an audible performance of a piece for later playback, connecting the device to a MIDI controller, recording a MIDI performance of a piece and later playing it back on another MIDI controller or through a software based MIDI player.

The device would allow the user to customize the aesthetic appearance of the device by removing and attaching various interchangeable faceplates thereby changing the appearance of the device. For example, violinists could apply a faceplate that contained images of violins, whereas a flautist could apply a faceplate containing images of their instrument. Faceplates could also include various colors and aesthetic designs. The appearance of the device could also be enhanced by customized stickers or electronic clip art that would appear on the screen of the device such as a thumbnail image of a violin or piano.

The device would include a built in wire stand that would function as both a supporting stand for placing the timer upright on a flat surface such as a table top, piano lid, or desktop and as a slide on clip for attaching to a instrumental music stand or other flat object. The device would include a lock-down switch for disabling various functions of the device including but not limited to metronome functions and practice timer activation. This would prevent the user from unintentionally pressing buttons on the device while they were transporting or storing it and prevent unintended recording of practice time, or metronome functions.

The device would allow the user to retain more than one record of practice time allowing the user to record practice time for more than one instrument on the same device.

An alternate embodiment features a slightly larger PractizPal that accommodates a larger screen size in order to display assignment information and other data. This design could also accommodate specified communications protocol such as a data port, an IR port, bluetooth technology, or a slot for data cartridge inserts.

The timer could also include various practice related functions built into the device or as optional add-on accessories such as an electronic tone generator used to tune instruments or provide a starting pitch for vocal performers, an electronic tuning device which is able to listen to an audible pitch and provide feedback to the user about the position of that pitch by means of an analog or digital display or to identify the pitch in relation to the notes of the musical scale, a means for playing music related audio files in formats such as MP3, WMA, or MC through headphones or built in speakers, a means of playing back music related video clips, or a means of playing games related to music or music education.

Devices that identify a pitch in relation to notes of a musical scale could be used to input a musical performance into the PractizPal without a physical data connection. The addition of any or all of these functions would further enhance the use of the PractizPal allowing it to better aid students in their musical progress and development.

The timer could also include various means of input built into the device or as optional add-on accessories to the device including but not limited to a typewriter keyboard, miniature typewriter keyboard, music keyboard, trackpad, mouse, trackball, thumbmouse, multidirectional navigation buttons, touch screen, stylus, sound activation, voice activation, data cartridge or other kinds of electronic cartridges or inserts, or other forms of magnetic, optical, or physical media.

The timer could also be combined with or built into various music related devices or appliances such as digital pianos or electronic keyboards, instrumental music stands or music racks, acoustical instruments of various kinds, accessories for musical instruments, instrument cases or carrying bags, or music bags such as those used for carrying music, books of various kinds including those that contain sheet music or instructional methods, or music folders designed to hold or store sheet music. This would allow the PractizPal to be incorporated into devices or items that musicians already use, adapting as much as possible to the needs of every musician.

An alternate embodiment features a key chain sized device that is powered by watch sized batteries and contains a more limited feature set. This embodiment could also be formatted as a miniaturized model including but not limited to a key chain, wristwatch, writing instrument, or other small pocket structure. The embodiment would likely feature a small watch sized display, an integrated chronometer and practice timer that would accommodate basic recording of practice time and display of practice over a period of weeks or months. It could however contain other more advanced functions as have been described for the primary embodiment of the device.

BRIEF DESCRIPTION OF THE DRAWINGS

FIG. 2*a* is a representation of the realtime view as it would be shown on the invention's display.

FIG. 2*b* is a representation of the weekly view as it would be shown on the invention's display.

FIG. 2*c* is a representation of a virtual tile moving in a vertical orientation as it would be shown on the invention's display.

FIG. 2*d* is a representation of the weekly view of a week chronologically preceding the week in FIG. 2*b* as it would be shown on the invention's display.

FIG. 2*e* is a representation of a virtual tile moving in a horizontal orientation as it would be shown on the invention's display.

FIG. 2*f* is a representation of the weekly view of a week that begins on a different day than the weeks in FIG. 2*b* and FIG. 2*d* as it would be shown on the invention's display.

DETAILED DESCRIPTION OF THE PREFERRED EMBODIMENT OF THE INVENTION

Figure 1:
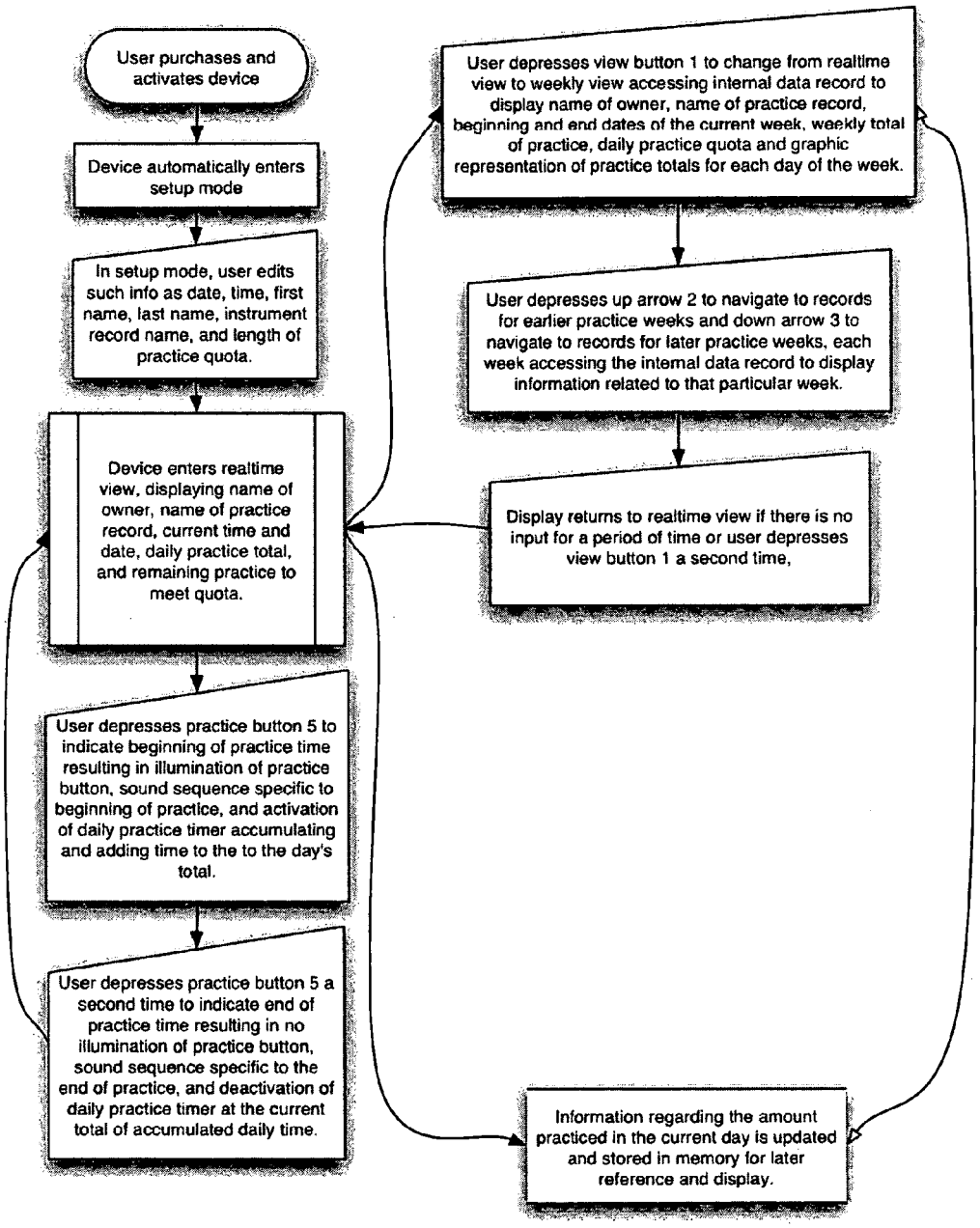
FIG. 1 is a flowchart describing the functionality of the PractizPal device.

Referring now to the drawings and more particularly to FIG. 1, what is shown is a flowchart illustrating the function of the invention in relation to the user's input of information, the device's processing of that information, and the feedback provided to the user through the device's display and various other means of output.

Figure 1A:
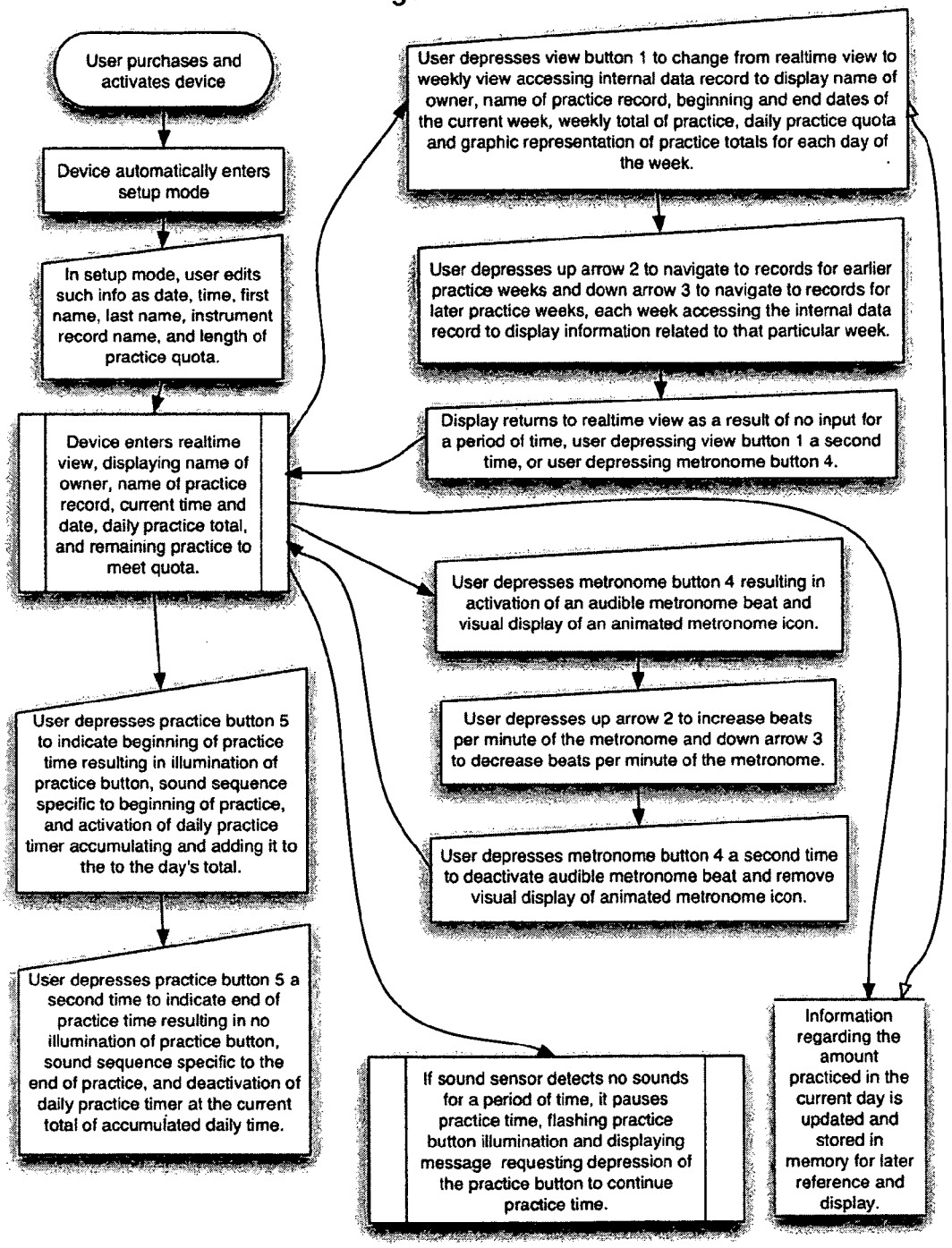
FIG. 1*a* is a flowchart describing the functionality of the PractizPal device with the added functionality of a metronome.

FIG. 1*a* illustrates through a flowchart the same functionality as FIG. 1 with the additional functionality of a built-in metronome.

Figure 2:
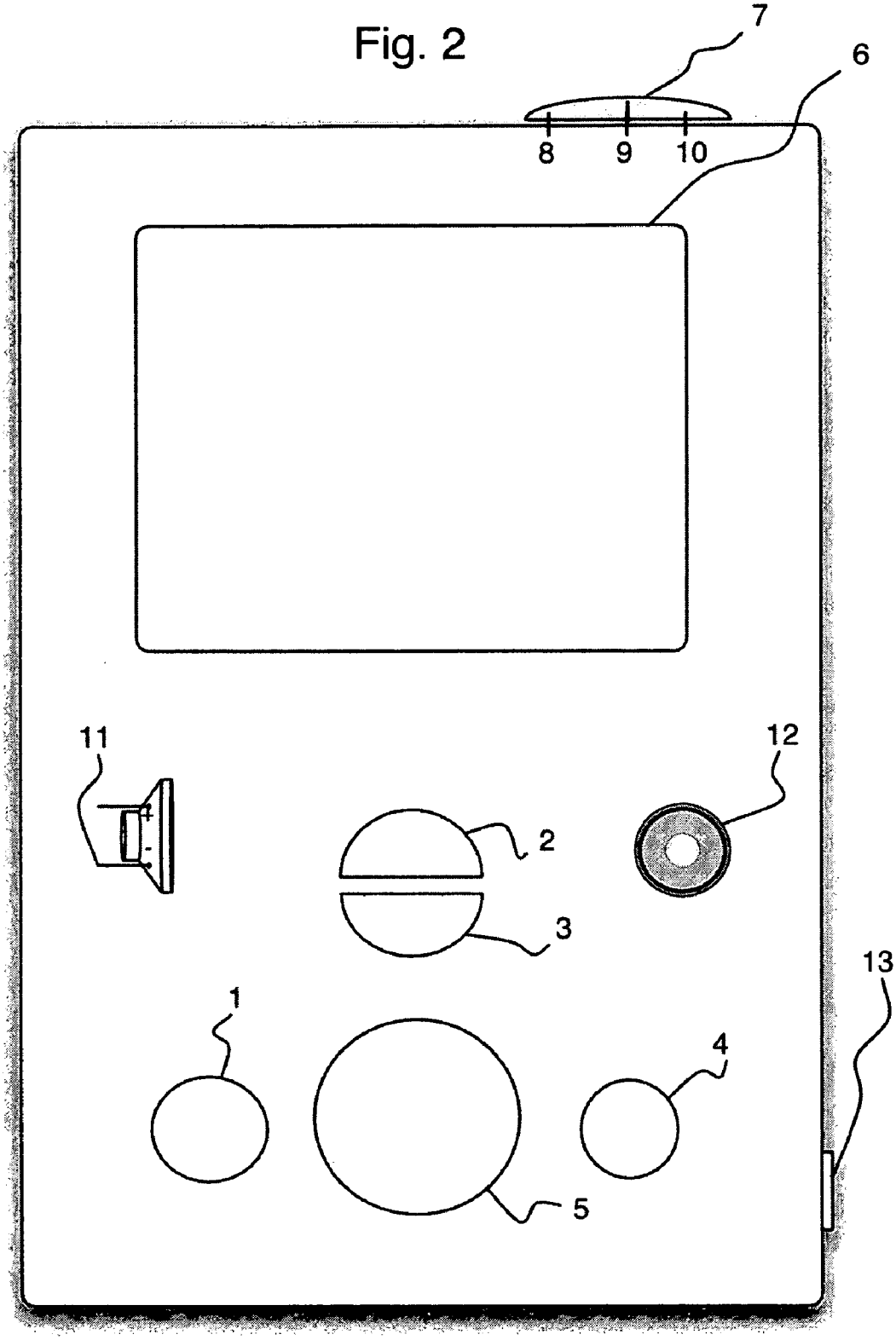
FIG. 2 is a view of an exemplary construction of the invention.

Referring now to FIG. 2, a preferred embodiment of the invention is shown in greater detail. A practice button 5 is used to indicate the beginning and ending of practice time. This button is the primary button in the function of the device and is therefore prominently placed. The button could accommodate various designs including but not limited to an opaque design, a translucent design, or a transparent design. The latter of two these designs would allow the user to observe changes in the lighting that would represent the passing of practice time or indicate when practice was in progress. A view button 1 is used to alternate between various views such as a realtime view FIG. 2*a*, and a weekly view FIG. 2*b*.

A metronome button 4 is used to turn a metronome function on or off. This button would be functional only in the realtime view although the metronome may be toggled off or on as a result of entering or leaving the weekly record view, or when practice is suspended for lack of sound. An up button 2 and down button 3 are multifunctional, functioning as an adjustment of metronome speed during realtime view, and as a navigator of past practice weeks in weekly record view. While being used to adjust the metronome speed during realtime view, buttons 2 and 3 would increase the beats per second in increments of one per button press, but when held down, would increase or decrease the beats per second by a greater amount such as 5 or 10. During weekly record view, button 2 would toggle to the preceding week chronologically and button 3 would toggle forward to the following week chronologically. A slide switch 7 would be able to move between three or more positions 8, 9, 10. Position 8 would place the device into a locked mode for travel or storage of the device. When the device was in this mode, all sound functions would be suspended including the metronome and buttons would be nonfunctional to prevent unintentional activation of the device. Positions 9 and 10 would toggle between alternate as well as independent practice records for musicians who practice for more than one instrument. This would allow students to track piano practice for example, while maintaining a separate record for voice practice or practice on another instrument. A built in speaker 11 would provide sound for an audible metronome function or other interface sounds. An internal LED light array 12 would provide for color changes in the device illuminating in various combinations to display different colors of light. The lights would changes colors in response to various functions such as the passing of time intervals during a practice session. These lights could also be mounted beneath the practice button 5 to illuminate the button during practice or could be mounted in other parts of the device. A settings button 13 would allow a teacher to change various infrequently altered settings such as those used to enter or change the name of the device owner or the name of a practice record, set the time, and change the daily practice quota. This button could be located in various locations including beneath the door to the battery compartment since it would primarily be intended for teacher or parent use. Setup functions will be described in more detail in FIG. 2*g*.

FIG. 2*a* illustrates the realtime view of the device. This would be the view that would seen by the student while practice is in progress. In the top left corner of the screen would be displayed the current time and date 14. A larger time display 15 would be located in the center of the screen and indicate the total amount of elapsed practice time in a day. A smaller display 16 would be located at the bottom of the screen and would indicate the amount of practice time remaining in a practice session relative to the user defined practice quota. If the daily practice total exceeded the quota, the word "remaining" 17 would disappear and a plus sign would appear beside the numeric display indicating the amount by which the amount exceeds the practice quota. A digital label located in the top left corner of the screen would indicate the first name of the device owner 18, the last name of the device owner 19, and the name of the practice record 20 (piano, voice etc.) A metronome display 21 would indicate the current speed of the metronome with the possibility of indicating the metronome beat visually through an animation of the metronome display.

FIG. 2*b* illustrates the weekly view of the device. The display of the dates encompassing the week 23 would be located in the top left corner of the screen. Directly beneath this display would be an indication of the total amount of time practiced in a week 24, 25. Identical to the realtime view would be the display 26 of the owner's name and instrument for which the practice record was recorded. Directly beneath this display would be a display 27 indicating the daily practice quota or amount of time the student is expected to practice in a day. Letter abbreviations 29 would represent the days of the week with a bar graph representation 32 indicating the amount of practice time in relation to the quota. Practice amounting to the daily quota would be represented by a full bar while practice times less than the daily quota would be represented by a partial bar. Practice exceeding the quota would be represented by a full bar with a plus sign 31 directly above it. A display above each bar 30 would indicate the exact amount of time practiced in that day. The current day and time beneath it 28 would flash to indicate that it was still in progress. The number indicating the weekly total of the week still in progress 25 would also flash.

In order to orient the user during navigation of weekly practice records in weekly view, a virtual tile FIG. 2*c* would slide up or down depending on the user navigation of the up and down button. Thus the screen representing the practice record for August 11-17th, 35, would virtually move down to be replaced by the week representing August 1-8th, 33. The movement of the virtual tile could be conveyed through various means including but not limited to all contents of the current screen (page) moving up or down as contents of the next page replace them, a bar 34 proceeding from one side of the screen to the other to indicate a change in position, or the contents of the screen simply disappearing from one end of the screen to the other to indicate a change in position.

When the screen transfer was complete, the screen would now display the practice record for the previous week as shown in FIG. 2*d*. The information for the that week would be displayed reflecting the differences in that particular week. The date display 36 would have changed to read August 3-10, the daily quota 37 reflecting whatever the quota was on the first day of that week, and the weekly total 38 reflecting whatever the weekly total was for that week. Because all practice in the week of August 1-8 would be completed without possibility of increase, there would be no flashing of the weekly total or of any day of the week. The user could continue to navigate and view practice records for other weeks preceding August 1-8. As he did so, the relevant displays would be continually updated to display the relevant information for each week respectively.

FIG. 2*e* illustrates a virtual tile 44 that would slide left to right as result of the user pressing the view button 1. This would indicate visually the change between realtime view 43 and weekly view 45. Effecting the concept of a virtual tile could be accomplished in various ways as was previously described in the descriptions of FIG. 2*d*.

FIG. 2*f* illustrates the ability to adjust weekly record view to accommodate scheduling of different students' lessons on different days of the week. Whereas the dates for FIG. 2*b* 20 proceed from August 11-17, the dates for FIG. 2*f* 42 have been adjusted to begin on August 13th which is Wednesday 46 and end on the following Tuesday. In FIG. 2*f*, the amount of time practiced on each day 49 would remain the same as the amount of time per day in FIG. 2*c* 30. The weekly total 48 however, would reflect the total of three days' practice instead of four. The current day of the week and weekly practice total 49 would flash just as they did in FIG. 2*b*, 22, 25 because they are still in progress. This would allow a teacher to coordinate a students practice schedule with the day of the week on which his lesson was scheduled thereby allowing for a view of his practice times for the entire period elapsed between lessons.

Figure 2G:
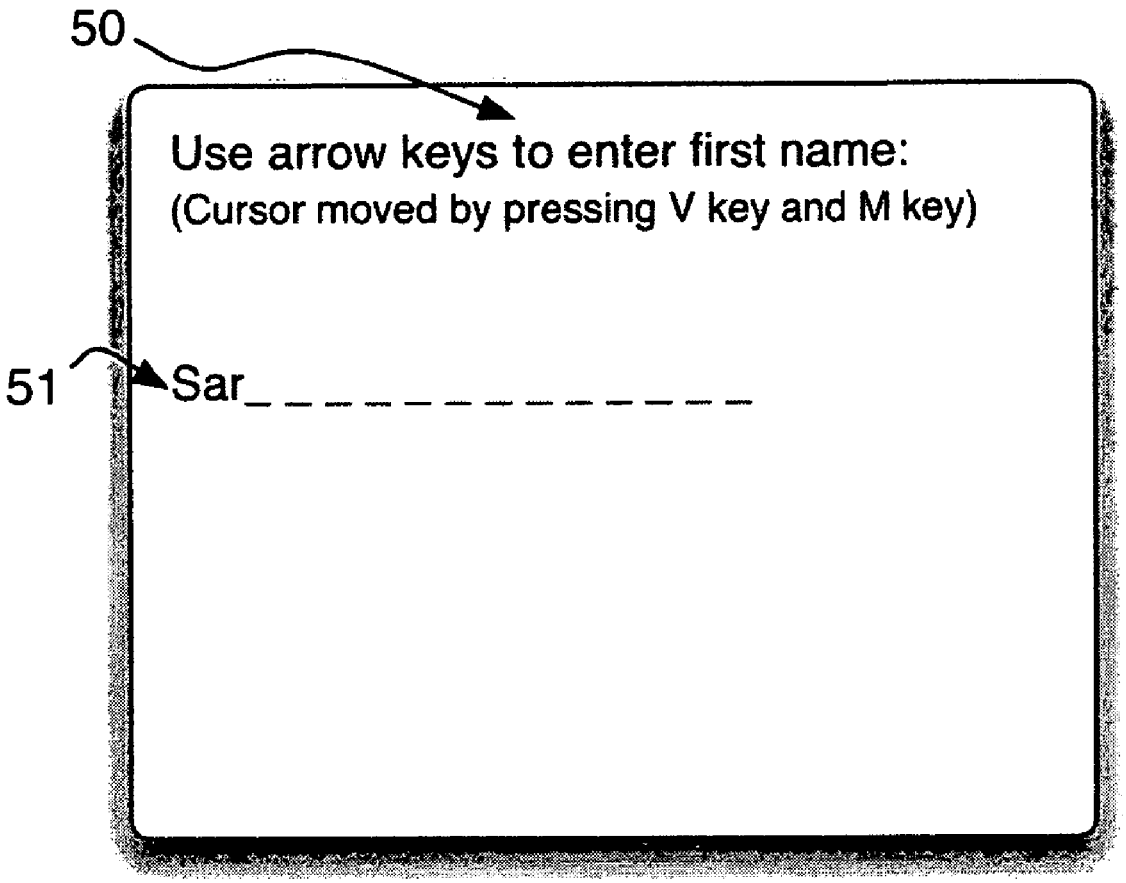
FIG. 2*g* is a representation of the setup function of the device that would allow the user to input information or change user settings as it would be shown on the invention's display.

FIG. 2*g* illustrates the setup function of the device. An text message 50 displayed in the top portion of the screen explains how to input text into the device while an alphanumeric display beneath shows inputted text and numeric information. In setup mode, arrow buttons 2 and 3 would allow selection of each individual letter by scrolling through the alphabet and/or numeric characters. In this mode, button 1 would move the cursor (which could be flashing or solid) to the left while button 4 would move the cursor to the right. Upon completing the text entry, the practice button would move the setup process to the next piece of information to be inputted such as the name of a practice record or a daily practice quota.

Figure 3:
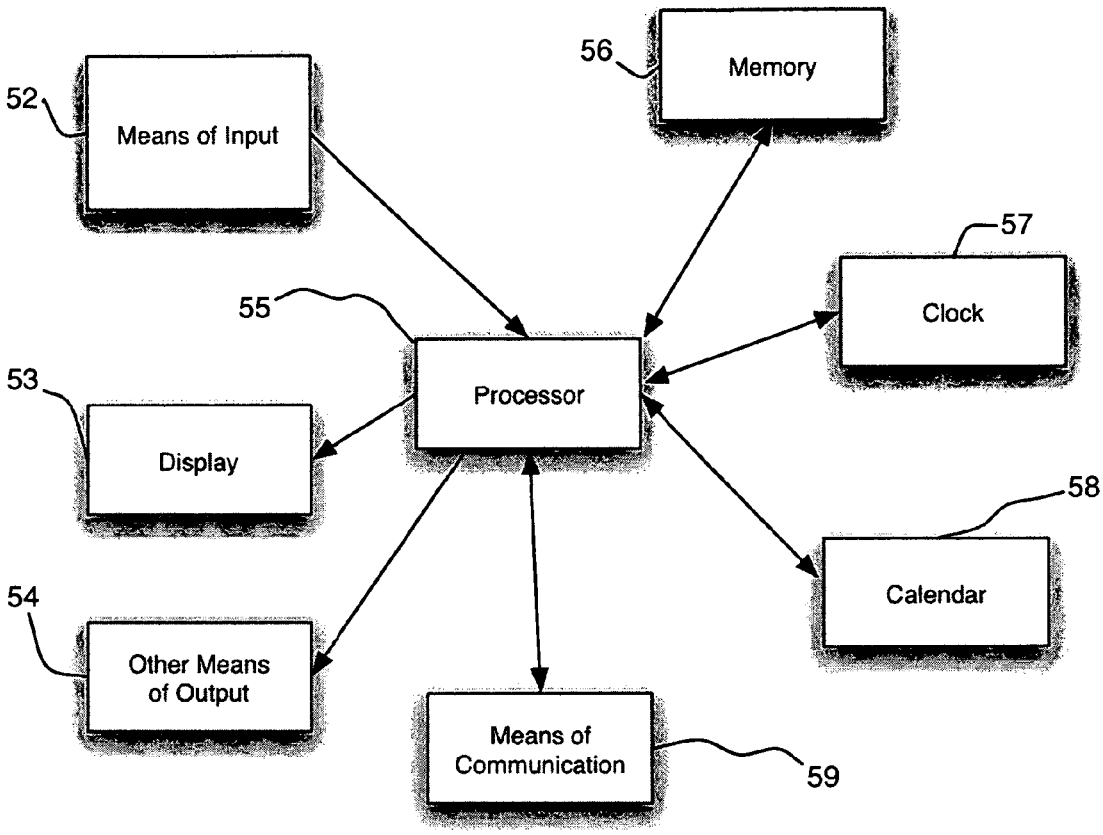
FIG. 3 Is a schematic diagram of the primary electronic components of the device and the relationships they have to each other based on the input, output, transfer and storage of information.

Referring now to FIG. 3, what is shown is a basic electrical diagram illustrating the primary components of the device and their interactions within the device. The fact that the invention is an electronic device and that all components picture in FIG. 3 are components that require electric current, implies that the device receives power from any kind of electrical source, including but not limited to various types of batteries including rechargeable batteries, or alternating current such as would be available in a home electrical system.

A processor 55 is shown which serves as the central controller for the rest of the system. Various means of input 52 would include but not be limited to momentary contact buttons or switches, toggle switches, slide switches, microphones, typewriter keyboard, miniature typewriter keyboard, music keyboard, trackpad, mouse, trackball, thumbmouse, multidirectional navigation buttons, touch screen, stylus, sound activation, or voice activation, data cartridges including various types of electronic cartridges or inserts, or other forms of magnetic, optical or patterned media. These various means of input 52 would communicate data directly to the processor 55 of the device.

A display 53 would receive information from the processor in order to provide visual feedback to the user of the device. The display could be of various types including but not limited to the following: LCD displays including pixelated displays such as those that provide a generic grid of segments, non-pixelated LCD displays such as those that relate to shape-specific segments, combinations of pixelated and non-pixelated LCD displays, reflective or backlit LCD displays, LED displays, or projected light displays such as those that display on a wall or ceiling. This display could also be accomplished by utilizing the graphical display capabilities of other autonomous devices such as televisions, computer monitors, handheld computers including various types of PDA's, cell phone displays, digital piano or keyboard displays, or other means of displaying graphical information electronically.

Various other means of output 54 would provide additional feedback to the user of the device regarding device functions, the means of feedback including but not limited to audible sounds such as a metronome tick or other sound effects produced, electronic sounds in a patterned sequence such as a melody or other musical pattern, or voice production that allow the device to deliver voice responses to the user. These sound functions could be accomplished through various types of electronic speakers, buzzers, or other sound production devices. Another means of feedback would be light production which could be accomplished through various means including but not limited to incandescent bulbs, LED lights of various colors, patterns, and brightness which could flash or pulse in various sequences or patterns, or physical vibrations produced internally by the device.

The device could also include various means of communication 59 in order to exchange data with various other external devices including but not limited to handheld computers such as those running the Palm, PocketPC or other operating systems, personal computers such as those running Mac OS, Windows, Linux or other operating systems, cell phones, internet servers, SOHO networks, or electronic MIDI keyboards, this communication being accomplished using various methods including but not limited to radio waves, infrared waves, USB1 or USB2, Firewire connection, docking station, Bluetooth standard, TCP/IP, WiFi connection, ethernet connection, MIDI devices, data port or other means of electronic communication. The information sent to and from these devices could include but would not be limited to practice history or other practice information, assigned practice quotas, information regarding assigned songs, practicing instructions for various songs, recommended amount of time to spend practicing certain songs, music dictionaries or other reference works, updates to the device's internal hardware, software or firmware systems, or other music related information, or information that allows the device to augment the function of other external devices or enhance its own function through various accessories including but not limited to electronic keyboards, docking stations, or other similar devices.

The memory portion of the device 56 would record various information including but not limited to the beginning and end of a practice period, the history of practice time for various distinct practice records, the first and last name of the user, the names of various distinct practice records, and device settings.

The clock 57 would provide the current time of day for reference by the processor 55. The processor's correlation of this information with user defined practice information will be discussed later in the description.

The calendar 58 would provide the current date including day, month, and year for reference by the processor. It would also calculate the current day of the week based on date information affected by leap year exceptions, the relevance of the algorithm covering a period of years equal to or exceeding the expected lifetime of the device.

The primary function of the processor 55 would be the correlation and integration of information from various means of input 52, memory 56, clock 57, and calendar 58, to provide user feedback to the display, other means of output, and communication between other devices or accessories. To describe this correlation in detail, the user would utilize various means of input to indicate various information including but not limited to the beginning and end of a practice period, the history of practice time for various distinct practice records, the first and last name of the user, the names of various distinct practice records, and device settings. The processor would drive the various means of input 52, display 53, and means of output 54 to provide a user interface for entering this information. Once the information was inputted, the processor would save it to memory.

When information regarding the beginning and end of a practice period was indicated by the user, the processor would relate this information to the time and date information provided by the clock 57 and calendar 58, to place a time-date stamp on the information and save it to the memory 56 for later reference. The processor would then be able to reference the time-date stamped information to calculate correlation's including but not limited to the total amount of time practiced in a day, total amount of time practiced in seven days, or the relationship of the total amount of time practiced in a day to the amount of time required in a day including the amount actual time exceeded the amount of time required in a day, or was less than the amount of time required in a day.

The processor would further function to display this information in various formats for the viewing by the user. One format in which the information could be displayed would be a literal display in alphanumeric form. Another format in which the information could be displayed would use a percentage algorithm to display the actual time/required time ratio in graphical form. One example of this would be a bar graph display with ten segments displayed, each representing a 10% portion of the required practice time. Segments that were displayed would represent the percentage of the required time that was represented by actual practice time. Upon processing the information in such a way that it could be displayed in these formats, the processor 55 would then communicate this processed information to the display and other means of output to provide user feedback.

The process of information input, information processing, information output, and the interface utilized to accomplish these functions is further described in other portions of this application's description.

Figure 4A:
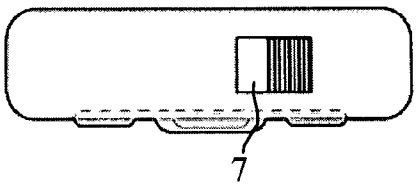
FIG. 4*a* shows a top view of a possible physical structure for the preferred embodiment of the device.
Figure 4:
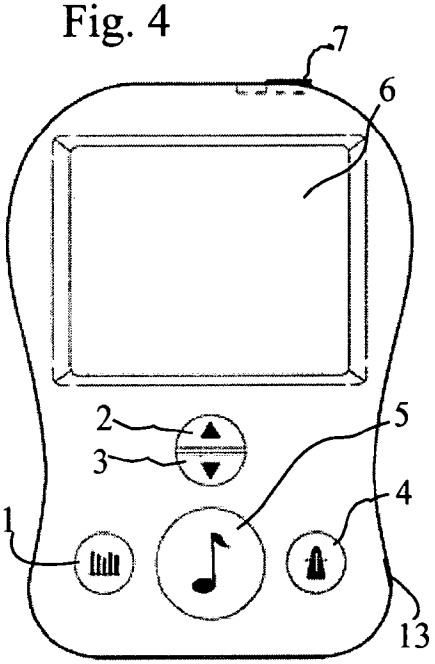
FIG. 4 shows a front view of a possible physical structure for the preferred embodiment of the device.
Figure 4B:
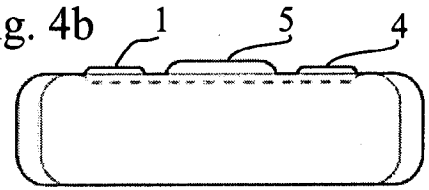
FIG. 4*b* shows a bottom view of a possible physical structure for the preferred embodiment of the device.
Figure 4C:
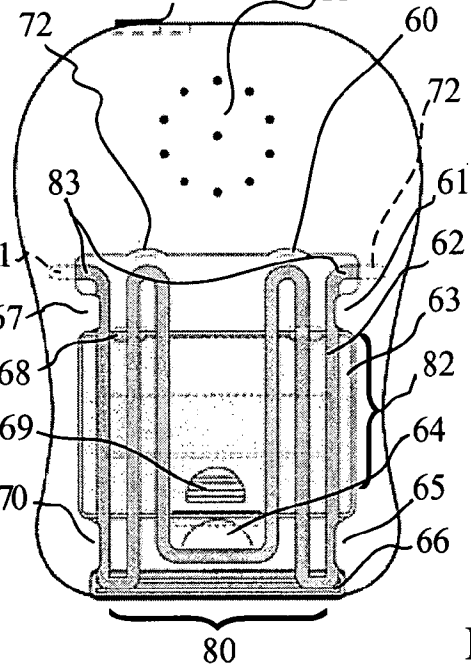
FIG. 4*c* shows a rear view of a possible physical structure for the preferred embodiment of the device.
Figure 4D:
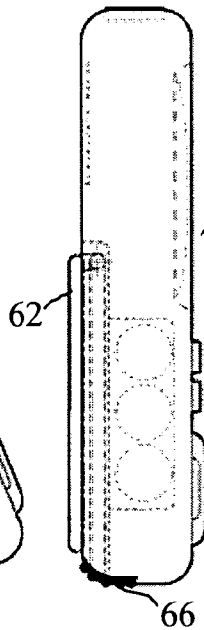
FIG. 4*d* shows a side view of a possible physical structure for the preferred embodiment of the device.
Figure 4E:
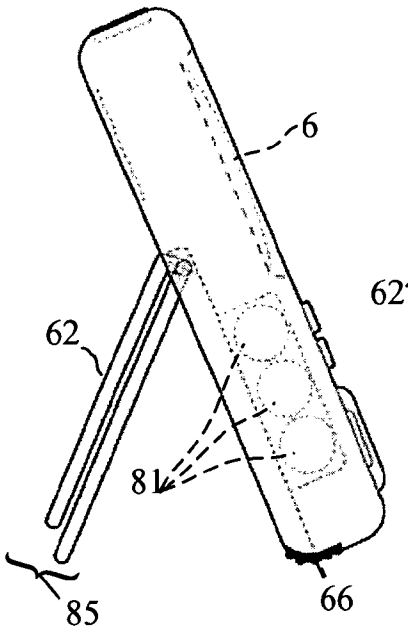
FIG. 4*e* shows a side view of a possible physical structure for the preferred embodiment of the device with the built in balance stand deployed.

Referring now to FIG. 4, what is shown is various views of a preferred embodiment of the invention. FIG. 4 shows the front view of the device illustrating the buttons and display also shown in FIG. 2. FIG. 4*c* shows the rear portion of the device illustrating more precise locations of the speaker 11, and another components of the device such as the multipurpose wire stand 62 and the battery compartment 82 under which batteries 81 are located to power the device. The shape of the wire stand 62 is unique allowing it function as a balance stand that would be used to stabilize the device on a flat surface, or as a clip that can slide onto a flat music stand or other similarly shaped object. It is to be noted that the wire stand 62 contains is constructed in two planes 85 as is visible in FIG. 4*e*, causing the central portion to protrude from the back of the device. This feature is essential to function of the wire stand 62 when it is functioning as a clip. The ends of the wire stand 83 are mounted in two holes 71, 72 allowing them to function as hinges for the stand. When the stand is deployed, it would swing out from the device until it was positioned at approximately 65° from the device. Indentations located directly above the wire stand 60 and 72 would limit the wire stand from deploying beyond the 65° angle. Plastic tabs 61, 65, 67, and 70 serve to secure the wire stand when it is not deployed from the device. A thumb indentation 64 enables more efficient access to the wire stand by the user. A battery cover 63 protects the battery compartment while avoiding interference with the motion of the wire stand 62, an indented portion of the battery cover 69 enabling more efficient removal of the battery cover 63. A rubberized strip 66 located on the bottom of the device 66 would provide traction for the base of the device when the wire stand 62 was deployed. The surface of the rubberized strip 66 would also contain protruding splines 80 that ran lengthwise down the strip 66 in order to increase the traction of the device when the wire stand 62 was deployed and the device was sitting on a flat surface.

It will be apparent to those skilled in the art that various modifications can be made to the concept of an electronic practice record without departing from the scope or spirit of the invention, and it is intended that the present invention cover modifications and variations of the electronic practice record provided they come within the scope of the appended claims and their equivalents.

What is claimed is:

1. An electronic activity timer for measuring elapsed time in music practice comprising:

a means for start and stop the measurement of elapsed time as a number of independent practice segments over a total amount of time elapsed;

a means for displaying the history of that elapsed time over a period of days, weeks and months by graphically displaying the independent practice segments over a predetermined period of time as an interconnected series of segments; a means for displaying the amount of practice time required in a day, week, month and year, whereby accumulated practice time is viewed in various user specified formats including total practice in a day, total practice in a week, and total practice in a month compared to the amount of practice time required in a day, week, month and year.

2. The apparatus as described in claim 1, wherein said timer allows the user to indicate information including but not limited to the beginning and ending of a practice session, the first and last names of the user, the required amount of time within a certain period, and user defined settings.

3. The apparatus as described in claim 1, wherein said timer records the time and date of user indicated practice time in a built in memory component over a period of days, weeks, months, and years.

4. The apparatus as described in claim 1, wherein said timer calculates the accumulated amount of user-specified practice time over a period of days, weeks, months, and years.

5. The apparatus as described in claim 1, wherein said timer further comprises a functional graphic display.

6. The apparatus as described in claim 1, wherein a time amount of user-specified practice or that time amount's relation to the user specified practice quota may be displayed in various representations including but not limited to the display of a week's practice record with a bar graph representing the amount of practice accumulated on each day of a given week with the ability to begin a week on a user specified choice of day, [or in] and a pie chart showing visually the amount of time practiced on a given day.

7. The apparatus as described in claim 1, wherein said timer is able to provide feedback to the user regarding various device functions including but not limited to the passing of practice time, metronome functions, and device functions of the like, the means of feedback including but not limited to colored LED lights mounted either one of externally and internally in an illuminating function, designated sounds and musical sequences, physical vibrations created internally by the device, recorded and synthesized voice messages, a visual graphic display of images either one of still and animated, and communication with external electronic devices.

8. The apparatus as described in claim 1, wherein said timer is able to communicate with other external devices, sending and receiving data using various means of communication including but not limited to radio waves, infrared waves, USB1 and USB2, firewire connection, docking station, bluetooth standard, TCP/IP, WiFi connection, ethernet connection, MIDI devices, signals broadcast by satellite and the like.

9. The apparatus as described in claim 1, wherein said timer is able to communicate with external devices including but not limited to handheld computers such as those running the Palm, Pocket PC or other operating systems, personal computers such as those running Mac OS, Windows, Linux and the like, cell phones, internet servers, SOHO networks, electronic MIDI keyboards.

10. The apparatus as described in claim 1, wherein said timer is able to send and receive data to and from external devices including but not limited to practice history and practice information, assigned practice quotas, information regarding assigned songs, practicing instructions for various songs, recommended amount of time to spend practicing certain songs, music dictionaries and reference works, updates to the device's internal functions, software and firmware systems, music related information, audio files in formats such as MP3, WMA, AAC, and the like audio formats, radio signals from local radio stations, signals that allow the apparatus to control another device, signals that allow other devices to control the apparatus, and information that allows the timer to augment the function of other external devices and enhance its communication functionality with other devices.

11. The apparatus as described in claim 1, wherein said timer includes a microphone or sound activated sensor for the purpose of triggering a switch to prevent the user from unintentionally accumulating practice time.

12. The apparatus as described in claim 7, wherein said timer is able to use a built in microphone, a other described means of electronic communication to receive voice commands that activate and deactivate various functions in the device, record music and types of sound for internal storage, external playback and record and play back MIDI information from an external MIDI controller for storage, editing, viewing and later playback through either one of a software based MIDI player and an external MIDI controller.

13. The apparatus as described in claim 1, wherein said timer allows the user to override the auto shutoff switch wherein the timer would continue to accumulate practice time.

14. The apparatus as described in claim 1, wherein said timer allows the user to customize the aesthetic appearance of the device by various means including but not limited to removing and attaching various interchangeable faceplates, adding adhesive stickers, graphical insert cards and graphic images in various sizes displayed on the screen of the device.

15. The apparatus as described in claim 1, wherein said timer features a built in wire stand that functions as both a supporting stand for placing the timer upright on a flat surface such as a table top, piano lid and desktop and also as a slide on clip for attaching to a instrumental music stand and flat objects.

16. The apparatus as described in claim 1, wherein said timer features a lock-down switch for disabling various functions of the device including but not limited to metronome functions and practice timer activation for the purpose of avoiding unintentional operation during transportation and storage.

17. The apparatus as described in claim 1, wherein said timer features more than one record of practice time allowing a user to record practice time for more than one instrument in separate data records on the same device.

18. The apparatus as described in claim 1, wherein said timer may include either one of a means of input built into the device and an optional add-on accessories to the device including but not limited to typewriter keyboard, miniature typewriter keyboard, music keyboard, trackpad, mouse, trackball, thumbmouse, multidirectional navigation buttons, touch screen, stylus, sound activation, voice activation data cartridge and kinds of electronic cartridges and inserts, including various forms of magnetic, optical and physical media.

19. The apparatus as described in claim 1, wherein said timer may include either one of various practice related functions built into the device and as optional add-on accessories for the device including but not limited to, an electronic tone generator such as those used to tune instruments and provide a starting pitch for vocal performers, an electronic tuning device which is able to listen to an audible pitch and provide feedback to the user about the position of that pitch by means of either one of an analog and a digital display to identify the pitch in relation to the notes of the musical scale, a means for playing musical audio files in formats such as MP3, WMA, AAC and like electronic audio formats, accomplishing this playback through headphones and built in speakers, a means of playing back music related video clips and a means of playing games related to music and music education.

20. The apparatus as described in claim 1, wherein said timer may be either one of a combined with and built into various music related devices and appliances including but not limited to digital pianos and electronic keyboards, instrumental music stands and music racks, acoustical instruments of various kinds, accessories for musical instruments, instrument cases and carrying bags, music bags such as those used for carrying music, books of various kinds including those that contain sheet music, instructional methods and music folders designed to hold and store sheet music.

21. The apparatus as described in claim 1, wherein said timer may be formatted as a miniaturized model including but not limited to a key chain, wristwatch, writing instrument and small pocket structure.

22. An electronic activity timer for measuring elapsed time in music practice comprising:

a means to start and stop said measurement as independent practice segments;

a means of separately recording independent practice segments; a means for displaying the amount of practice time required in a day, week, month and year; a means for displaying the distribution of total elapsed time over a period of a day, weeks, months and year by graphically displaying the independent practice segments over a period of time as an interconnected series of separate segments; and a metronome for independently providing the proper timing for music.

23. A method of measuring total elapsed time in music practice, including the steps of: starting and stopping the measurement of total elapsed time; recording that time electronically; integrating that record with a means of measuring a recording date; and graphically displaying the history of the elapsed practice time over a period of days, weeks, months and years in compared to the display of the amount of practice time required in a day, week, month and year.

* * * * *